US005273013A

United States Patent [19]

Kubis et al.

[11] Patent Number: 5,273,013

[45] Date of Patent: Dec. 28, 1993

[54] DEVICE FOR CONTROLLING AN OUTLET VALVE IN THE ENGINE BRAKE MODE

[75] Inventors: Heribert Kubis; Dieter Wittmann, both of Nürnberg, Fed. Rep. of Germany

[73] Assignee: MAN Nutzfahrzeuge AG, Munich, Fed. Rep. of Germany

[21] Appl. No.: 33,806

[22] Filed: Mar. 19, 1993

[30] Foreign Application Priority Data

Mar. 26, 1992 [DE] Fed. Rep. of Germany ..... 4209775

[51] Int. Cl.[5] ..... F02D 13/04

[52] U.S. Cl. ..... 123/321

[58] Field of Search ..... 123/90.16, 320, 321, 123/322

[56] References Cited

U.S. PATENT DOCUMENTS

| | | | |
|---|---|---|---|
| 3,786,792 | 1/1974 | Pelizzoni et al. | 123/321 |
| 4,164,917 | 8/1979 | Glasson | 123/321 |
| 4,930,463 | 6/1990 | Hare, Sr. | 123/321 |
| 5,086,738 | 2/1992 | Kubis et al. | 123/322 |
| 5,150,678 | 9/1992 | Wittmann et al. | 123/321 |
| 5,161,500 | 11/1992 | Kubis et al. | 123/321 |

FOREIGN PATENT DOCUMENTS 3922884 5/1992 Fed. Rep. of Germany .

*Primary Examiner*—Willis R. Wolfe

*Attorney, Agent, or Firm*—Robert W. Becker & Associates

[57] ABSTRACT

A device for controlling an outlet valve during the engine brake mode has a hydraulic linkage between the outlet valve and the cam shaft which is controllable by a control unit. The control unit is combined with an actuation piston of a pressure source to form an integral component which is identical for each outlet valve. The actuation piston is actuated by a brake cam and actuates the working piston of the hydraulic linkage via the intermediate control unit. With the actuation piston the outlet valve can be opened during the engine braking mode in the compression stroke in order to substantially increase the braking power of the engine. The combination of the control unit with the actuation piston in the form of an integral component allows for an inexpensive manufacture because each individual outlet valve can be provided with such an identical control component. Furthermore, by eliminating long connecting lines for the pressure medium with the integral component precise control times for the outlet valve can be achieved.

4 Claims, 2 Drawing Sheets

DEVICE FOR CONTROLLING AN OUTLET VALVE IN THE ENGINE BRAKE MODE

BACKGROUND OF THE INVENTION

The present invention relates to a device for controlling an outlet valve during the engine brake mode, wherein the device comprises a hydraulic linkage between the outlet valve and the cam shaft, the hydraulic linkage being supplied with hydraulic pressure from a pressure source upon switching to the engine brake mode. The pressure source is comprised of an actuation piston which is actuated by one brake cam per cylinder arranged at the cam shaft that drives the inlet and outlet valves. The outlet valve is opened by the hydraulic pressure by lifting a working piston within the hydraulic linkage during the engine brake mode.

From German Offenlegungsschrift 39 22 884 a hydraulic linkage is known which is arranged between a cam shaft and an outlet valve and which serves during the engine brake mode to lift the outlet valve during the compression stroke in order to increase the braking power. The hydraulic linkage is comprised of a valve rod in which a working piston is movably arranged and which, with respect to the valve rod, has an axial stroke in the direction to a push rod. The axial stroke corresponds to the opening stroke of the outlet valve during the engine braking mode. For the purpose of lifting the outlet valve during the compression stroke a compression chamber is arranged below the working piston and is connected via pressure lines to an external pressure source which during the engine brake mode is driven by the cam shaft. The pressure source loads the working piston in a cyclic manner in order to open the outlet valve also during the compression stroke of the engine when the valve rod itself rests on the base circle of the outlet cam. When the outlet valve is opened during the exhaust stroke, the pressure chamber is without load from the pressure source so that the outlet valve, after exhausting the play between the working piston and the valve rod, is opened by the outlet cam during engine operation. Such a pressure source and control unit require a great constructive expenditure with high costs even when mass-produced. A combination of pressure source and control unit of identical construction can only be used for internal combustion engines with the same number of cylinders because when the number of cylinders of the combustion engine is changed, a change of the number of actuation pistons of the pressure source is also required.

It is therefore an object of the present invention to provide a device with a hydraulic linkage having a control unit that is designed such that it is applicable for internal combustion engines of any desired number of cylinders whereby the control unit itself must not be altered. A further object of the present invention is the elimination of outwardly arranged pressure lines for achieving a precise control of the outlet valve.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
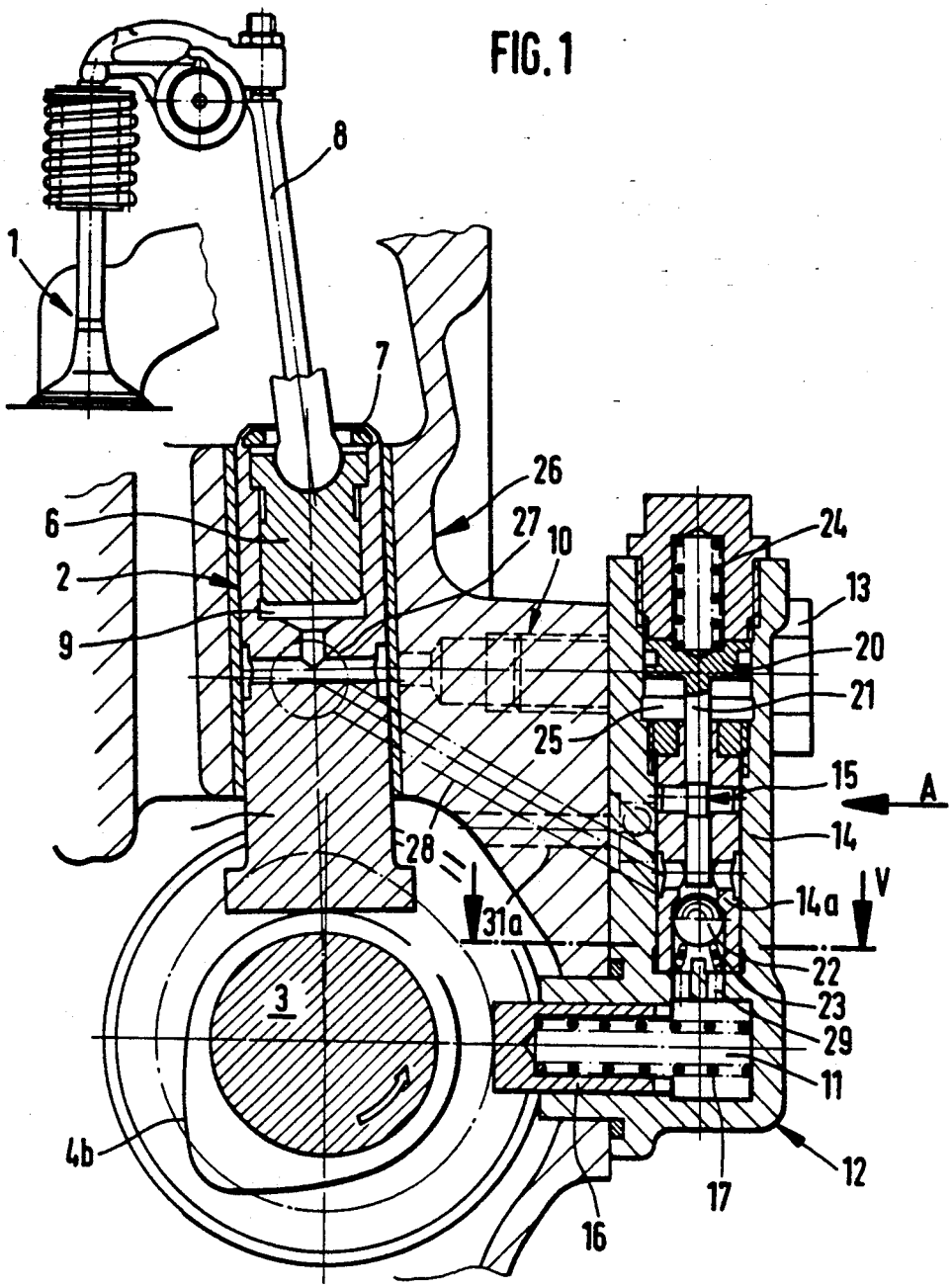
FIG. 1 shows a section I—I of an integral component comprised of the pressure source and the control unit as well as a cam shaft and the hydraulic linkage.

The device for controlling an outlet valve of an inner combustion engine, having a cam shaft with inlet cams and outlet cams for opening the inlet and outlet valves during normal engine operation, according to the present invention is primarily characterized by;

A hydraulic linkage positioned between the cam shaft and the outlet valve, the hydraulic linkage comprising a working piston with a first and a second end, the first end connected to the outlet valve and a first pressure chamber positioned at the second end of the working piston, and further comprising an abutment opposite the first pressure chamber for limiting a stroke of the working piston;

A pressure source for supplying a pressure medium to the first pressure chamber, the pressure source comprising an actuation piston and a second pressure chamber, the actuation piston axially displaceable in the second pressure chamber;

A brake cam connected to the cam shaft for displacing the actuation piston;

A means for connecting the second pressure chamber to the first pressure chamber, the means for connecting comprised of a first line a second line, and a hollow screw having an inner bore;

A control unit for controlling the supply of the pressure medium to the first pressure chamber;

A common housing for the pressure source and the control unit, the pressure source and the control unit in the housing forming an integral component, the housing having an inner receiving member;

The control unit comprised of a control piston with a piston rod and a return spring, the control piston axially displacably guided within the inner receiving member of the housing and biased into a rest position by the return spring, the control unit having a third pressure chamber at an end of the control piston opposite the return spring;

The control unit further comprising a ball valve with a first and a second end, wherein a free end of the piston rod in the rest position acts on the ball valve and forces the ball valve into an open position;

A supply line connected between the first end of the ball valve and the second pressure chamber;

A central supply line for supplying the pressure medium to the second pressure chamber and a connecting line connecting the central supply line to the second end of the ball valve, wherein in the open position of the ball valve the second pressure chamber is connected via the supply line, the ball valve, and the connecting line to the central supply line; and A compressed air line connected to the third pressure chamber for supplying compressed air to the third pressure chamber, wherein, upon switching from the engine propelling mode to the engine braking mode, the third pressure chamber is supplied with compressed air such that the control piston is displaced against the return spring and the ball valve is returned into a closed position, in which closed position the actuation piston is displaced by the brake cam and generates a pressure in the second pressure chamber, the means for connecting and the first pressure chamber so that the working piston is displaced toward the abutment and opens the outlet valve.

Because each cylinder of an internal combustion engine is provided with a constructively identical component, comprised of the pressure source and the control unit, this integral component can be designed identically for internal combustion engines with different numbers of cylinders. This results in a more efficient mass production.

Preferably, each cylinder of the engine has one of the integral components. It is also possible to combine two of the integral components to a pair. In an alternative it is possible to combine at least one of the integral components with other components of the engine to form an integral constructive unit.

The integral component which remains unchanged with respect to its construction based on the pressure source and the control unit can be adapted to constructive differences of internal combustion engines by combining them with other components thereof. An inexpensive mass production is not impaired by optionally advantageously combining the integral component with other components of the internal combustion engine.

DESCRIPTION OF PREFERRED EMBODIMENTS

Figure 2:
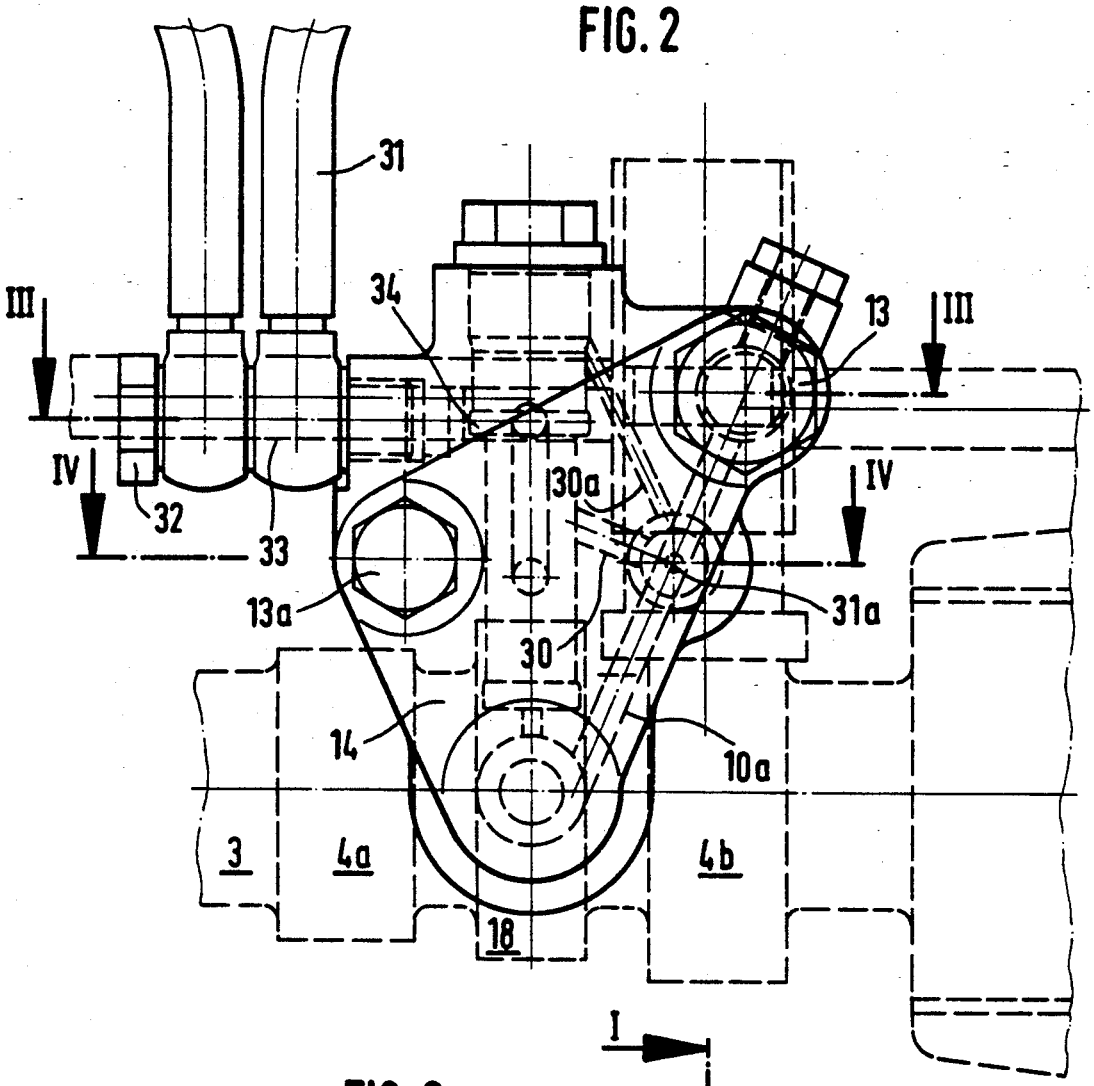
FIG. 2 shows a view A according to FIG. 1.

The inventive device for controlling the outlet valve and switching between the engine propelling mode and the engine braking mode is shown in FIG. 1 in a cross-sectional view I—I. An outlet valve 1 is actuated by an outlet cam 4*b* via the intermediate hydraulic linkage 2. The hydraulic linkage 2 is comprised of a valve rod 5 which represents the cylinder for the working piston 6. This working piston 6 is axially displacably arranged within the valve rod 5 and is limited in its upward stroke by an abutment 7. The movement of the working piston 6 is transferred to the outlet valve 1 by a push rod 8. Below the working piston 6 a pressure chamber 9 is provided which is connected by a means for connecting in the form of pressure oil (medium) connection with a first line (bore) 10 and a second line (bore) 10*a* (FIG. 2) to a second pressure chamber 11 of the pressure source 12. The connection for the pressure medium is comprised of a first bore 10, a hollow screw 13 and a second bore 10*a* within the housing 14 (FIG. 2). The housing 14 inventively combines the control unit 15 and the actuation piston 16 of the pressure source 12 as an integral component. The actuation piston 16 is maintained in a rest position by a first return spring 17. The actuation piston 16 can be displaced against the force of the first return spring 17 by a brake cam 18 connected to the cam shaft 3. The housing 14 encloses the control unit 15 which is comprised of a control piston 20 and a piston rod 21 as well as a ball valve 22. The ball valve 22 is forced into its sealing seat during the engine braking mode by a spring 23, and is opened during normal engine propelling operation by the piston rod 21, guided within the inner receiving member 14*a* of the housing, when the control piston 20 is downwardly displaced by a second return spring 24. In the drawing FIG. 1 the device is shown in the engine braking mode: The third pressure chamber 25 is loaded by compressed air, the control piston 20 is lifted against the force of the second return spring 24, and the ball valve 22 is in its closed position.

For supplying oil (pressure medium) from a non-represented lubrication system a central supply bore 27 is provided within the cylinder housing/crank case 26 which is connected via a connecting line 28 and the open ball valve 22 as well as the supply line 29 to the second pressure chamber 11.

FIG. 2 shows a view A according to FIG. 1. The constructive unit of the actuation piston and the control unit is enclosed by the housing 14 and connected with hollow screw 13 and screw 13*a* to the cylinder housing/crank case housing 26 (FIG. 1). The second pressure chamber 11 (FIG. 1) is connected with a first bore 10 and a second bore 10*a* and the hollow screw 13 to the pressure chamber 9 below the working piston 6 (FIG. 1).

Furthermore, a third bore 30 is provided which opens via a valve chamber 35 (FIG. 4) into the leak oil bore 31*a* (FIG. 1 and 4) and removes leak oil which can penetrate through the guide of the piston rod 21 into the interior of the housing 14.

Figure 4:
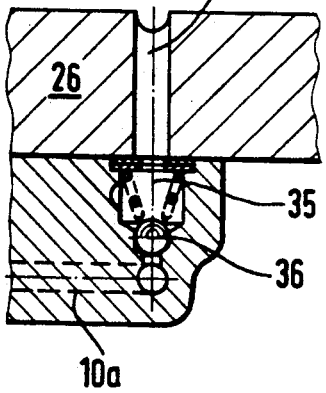
FIG. 4 shows a cross-section IV—IV as a detail of a safety valve and a leak oil bore.

In order to be able to vent the space between the inner receiving member 14*a* and the housing 14 (FIG. 1) a venting bore 30*a* is provided which opens also into the valve chamber 35 (FIG. 4).

For switching to the engine braking mode, the third pressure chamber 25 (FIG. 1) is connected via compressed air lines 31, a screw 32 with bore 33, and a connecting bore 34 to a compressed air source, not represented in the drawing, for lifting the control piston 20 with piston rod 21 into the position represented in FIG. 1. The cam shaft 3 has an inlet cam 4*a*, an outlet cam 4*b* and intermediately positioned a brake cam 18 for actuating the actuation piston 16.

Figure 3:
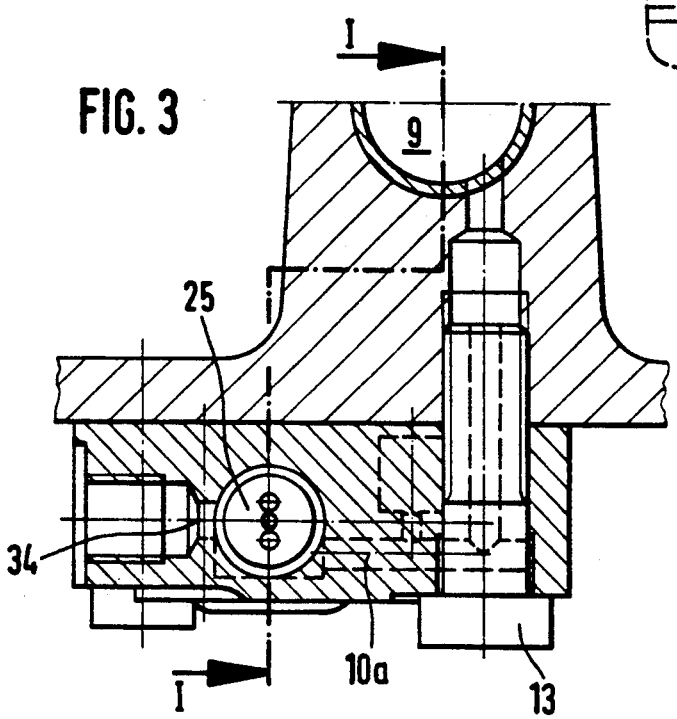
FIG. 3 shows a cross-section along the line III—III at the connection for compressed air, showing also the section line I—I.

FIG. 3 shows in detail a section III—III of FIG. 2. Compressed air is guided via the connecting bore 34 into the third pressure chamber 25 which is arranged below the control piston 20 of FIG. 1. The second bore 10*a* is shown which via the bore of the hollow screw 13 and the first bore 10 connects the second pressure chamber 11 of the actuation piston 16 with the first pressure chamber 9 below the working piston 6 (FIG. 1).

For removing leakage a leak oil bore 31*a* is provided (FIG. 4) which connects the valve chamber 35 with the interior of the cylinder housing/crank case 26. The valve chamber 35 is connected with the third bore 30 and the venting bore 30*a* as represented in FIG. 2. In order to prevent an unsuitably high pressure increase within the second pressure chamber 11 (FIG. 1), a safety valve 36 is provided which is connected to the high pressure line 10*a* so that in case a high pressure occurs in this high pressure line 10*a* oil may be removed via the leak oil bore 31*a*.

Figure 5:
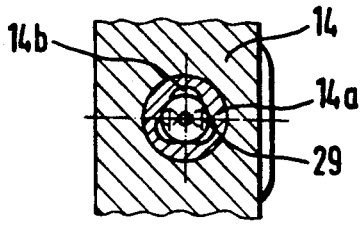
FIG. 5 shows a cross-section V—V in the area between the ball valve and the second pressure chamber.

A detail at the transition from the ball valve 22 to the second pressure chamber 11 is represented in FIG. 5 as a section V—V of FIG. 1. The housing 14 comprises an inner receiving member 14*a* with valve pockets 14*b* and a supply bore 29 via which oil can be supplied to the second pressure chamber 11 from the lubrication system.

In the following, the function of the device will be explained.

During engine braking mode compressed air, controlled by non-represented solenoids, is guided via the compressed air line 31, the hollow screw 32 with its bore 33 to the third pressure chamber 25. Accordingly, the control piston 20 and the piston rod 21 are lifted against the force of the second return spring 24, as represented in FIG. 1, and the ball valve 22 is closed by the force of the spring 23. When the brake cam 18 approaches the actuation piston 16, the piston 16 is displaced against the force of the first return spring 17 and the oil, respectively, pressure medium within the second pressure chamber 11 is pressurized. This pressure travels via the second bore 10*a*, the hollow screw 13, and the first bore 10 to the first pressure chamber 9 below the working piston 6 and lifts the working piston 6 until the stroke of piston 6 is stopped by the abutment 7. The valve rod 5 during this step rests at the base circle of the outlet cam 4*b*. By lifting the working piston 6 toward the abutment 7, the outlet valve 1 is slightly opened by the push rod 8 in order to release compressed air during the compression stroke. With a nonrepresented throttle valve the counter pressure can be controlled during the engine braking mode. After further rotation of the cam shaft 3 the valve rod 5 is lifted by the outlet cam 4*b* and the actuation piston 16 rests at the base circle of the brake cam 18. The valve rod 5 transmits its movement by contacting the working piston 6 directly to the push rod 8 and the outlet valve 1. During the exhaust stroke braking work can again be performed.

During the normal engine propelling mode the non-represented solenoids are closed and the compressed air line 31 is vented. The control piston 20 together with its push rod 21 is forced in a downward direction by the second return spring 24 and opens the ball valve 22. Accordingly, no pressure exceeding the pressure of the oil present in the line 27 can be generated within the second pressure chamber 11 by the movement of the actuation piston 16. The working piston 6 remains in its lower initial position.

The outlet valve 1 therefore can only be lifted during the exhaust stroke by the outlet cam 4*b*. For refilling oil the central supply line 27 is connected to the second pressure chamber 11 via the connecting line 28 with the space within the control unit 15 and via the ball valve 22 which is permanently open during normal engine propelling operation. The central bore 27 is connected to a non-represented lubrication system.

The present invention is, of course, in no way restricted to the specific disclosure of the specification and drawings, but also encompasses any modifications within the scope of the appended claims.

What we claim is:

1. A device for controlling an outlet valve of an inner combustion engine during engine braking mode, the engine having a cam shaft with outlet cams for opening outlet valves and inlet cams for opening inlet valves during an engine propelling mode, said device comprising:

a hydraulic linkage positioned between the cam shaft and the outlet valve, said hydraulic linkage comprising a working piston with a first and a second end, said first end connected to the outlet valve, and a first pressure chamber positioned at said second end of said working piston, and further comprising an abutment opposite said first pressure chamber for limiting a stroke of said working piston;

a pressure source for supplying a pressure medium to said first pressure chamber, said pressure source comprising an actuation piston and a second pressure chamber, said actuation piston axially displaceable in said second pressure chamber;

a brake cam connected to the cam shaft for displacing said actuation piston;

a means for connecting said second pressure chamber to said first pressure chamber, said means for connecting comprised of a first line, a second line, and a hollow screw having an inner bore;

a control unit for controlling the supply of the pressure medium to said first pressure chamber;

a common housing for said pressure source and said control unit, said pressure source and said control unit in said housing forming an integral component, said housing having an inner receiving member;

said control unit comprised of a control piston with a piston rod and a return spring, said control piston axially displaceably guided within said inner receiving member of said housing and biased into a rest position by said return spring, said control unit having a third pressure chamber at an end of said control piston opposite said return spring;

said control unit further comprising a ball valve with a first and a second end, wherein a free end of said piston rod in said rest position acts on said ball valve and forces said ball valve into an open position;

a supply line connected between said first end of said ball valve and said second pressure chamber;

a central supply line for supplying the pressure medium to said second pressure chamber and a connecting line connecting said central supply line to said second end of said ball valve, wherein in said open position of said ball valve said second pressure chamber is connected via said supply line, said ball valve, and said connecting line to said central supply line; and a compressed air line connected to said third pressure chamber for supplying compressed air to said third pressure chamber, wherein, upon switching from the engine propelling mode to the engine braking mode, said third pressure chamber is supplied with compressed air such that said control piston is displaced against said return spring and said ball valve is returned into a closed position, in which closed position said actuation piston is displaced by said brake cam and generates a pressure in said second pressure chamber, said means for connecting and said first pressure chamber so that said working piston is displaced toward said abutment and opens the outlet valve.

2. A device according to claim 1, wherein each cylinder of the engine has one said integral component.

3. A device according to claim 1, wherein two said integral components are combined to a pair.

4. A device according to claim 1, wherein at least one said integral component is combined with other components of the engine to form an integral constructive unit.

* * * * *